United States Patent [19]

Ryberg

[11] 4,122,820

[45] Oct. 31, 1978

[54] ENGINE COVER AND AIR CLEANER SUPPORT

[75] Inventor: John G. Ryberg, Peoria, Ill.

[73] Assignee: Caterpillar Tractor Co., Peoria, Ill.

[21] Appl. No.: 802,612

[22] Filed: Jun. 2, 1977

[51] Int. Cl.[2] ..... F02B 75/22; F02B 77/00

[52] U.S. Cl. ..... 123/198 E; 123/52 MV; 123/195 C; 123/195 S; 181/204

[58] Field of Search ..... 123/198 E, 195 C, 195 S, 123/52 MV; 181/204

[56] References Cited

U.S. PATENT DOCUMENTS

| | | | |
|---|---|---|---|
| 2,869,526 | 1/1959 | Dolza | 123/52 MV |
| 2,871,842 | 2/1959 | Dolza | 123/52 MV |
| 2,963,009 | 12/1960 | Dolza | 123/198 E X |
| 3,521,726 | 7/1970 | Freyn | 123/198 E X |
| 3,534,828 | 10/1970 | LePage Fuer | 123/198 E |
| 3,783,845 | 1/1974 | Brandstetter | 123/52 MV X |
| 3,949,726 | 4/1976 | List | 123/198 E |
| 3,990,419 | 11/1976 | Ltakura | 123/198 E X |
| 4,011,849 | 3/1977 | Latham | 123/198 E |

*Primary Examiner*—Ira S. Lazarus
*Attorney, Agent, or Firm*—John L. James

[57] ABSTRACT

A cover is provided for an engine which has first and second spaced-apart portions and an air cleaner. The cover has a middle portion, first and second opposed side portions, and first and second opposed end portions. The side and end portions are connected to the engine and form a chamber defined by the engine portions and the cover. The air cleaner is mounted on the middle portion of the cover.

8 Claims, 3 Drawing Figures

Fig-1-
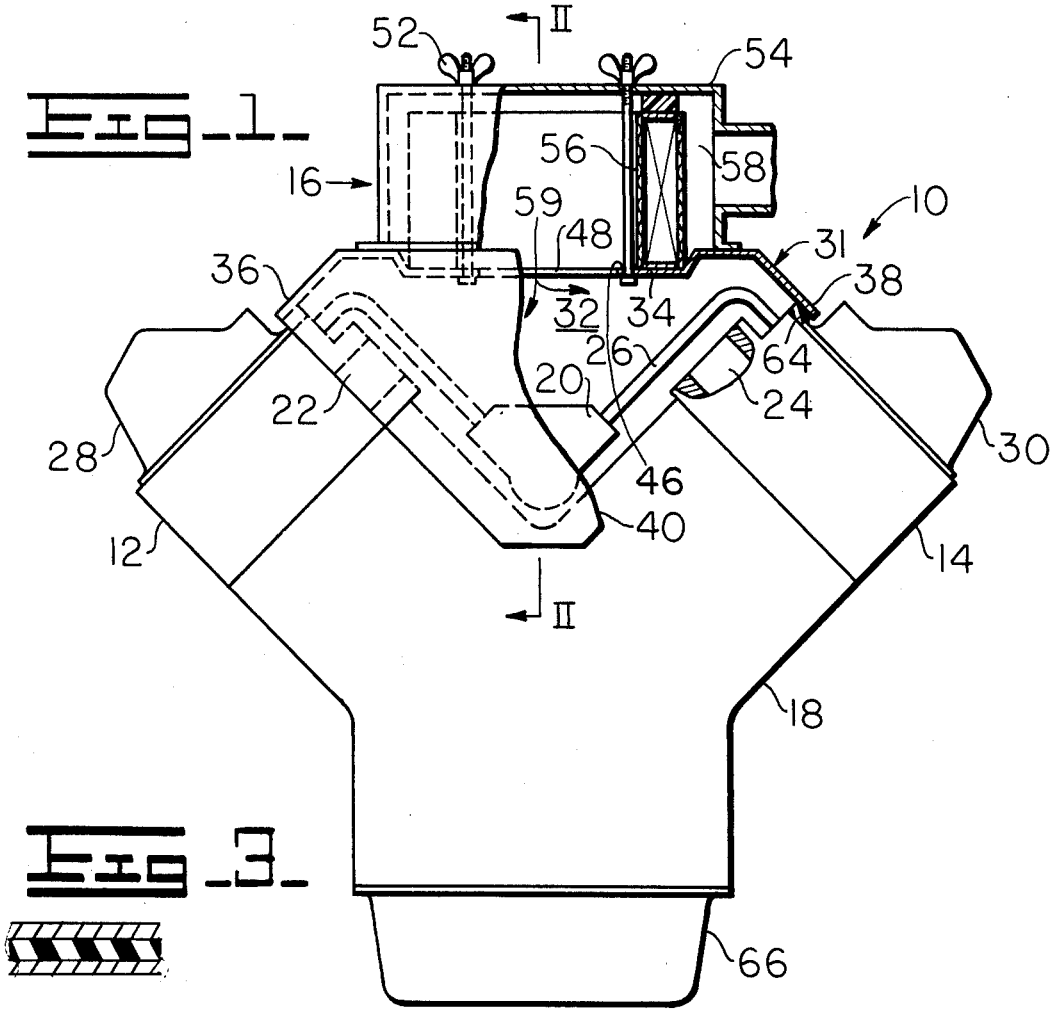
Fig-3-
Fig-2-
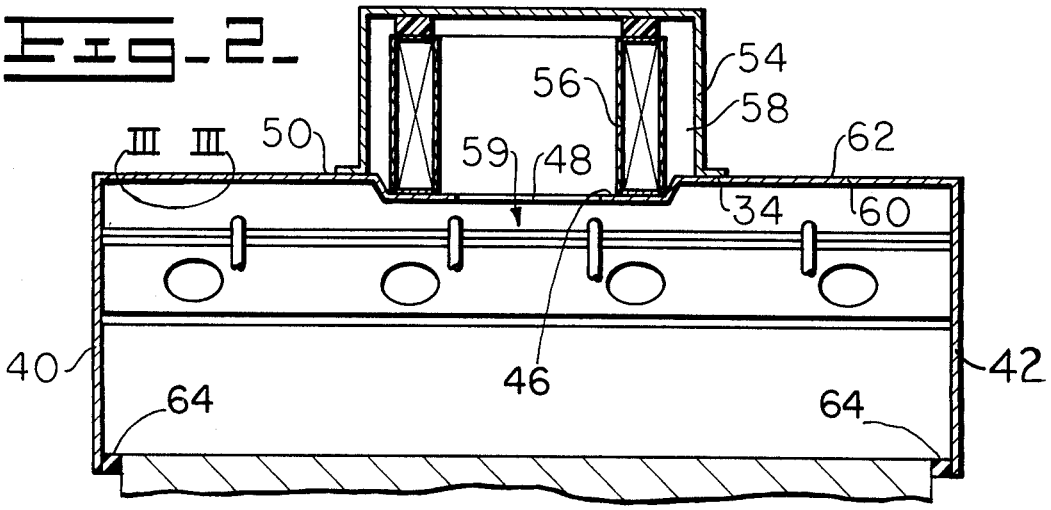

ENGINE COVER AND AIR CLEANER SUPPORT

BACKGROUND OF THE INVENTION

Current engines, such as vee type diesel engines, for example, produce a certain amount of noise during normal operation. It is desirable to limit the noise to levels below existing regulations. A primary noise source in a typical diesel engine is the fuel pump. Fuel pump noise can be reduced by covering the vee of the engine where the pump is located with an acoustic barrier. The barrier must be hermetically tight to be effective. The barrier is expensive because the barrier must fit around the air cleaner outlet, the piping from the cleaner to the cylinder heads, and the individual fuel lines. It is desirable to have a barrier which is easy to manufacture and does not significantly increase the total cost of the diesel engine.

SUMMARY OF THE INVENTION

The present invention is directed to overcoming one or more of the problems as set forth above.

According to the present invention, a cover is provided for an engine which has first and second spaced-apart portions and an air cleaner. The cover has a middle portion, first and second opposed side portions and first and second opposed end portions. The side portions are sealably connected to the respective engine portions. The end portions each extend between the engine portions and are connected to the engine portions and form a chamber defined by the engine portions and the cover. The air cleaner is mounted on the middle portion of the cover.

BRIEF DESCRIPTION OF THE DRAWINGS

FIG. 1 is a diagrammatic transverse cross-sectional view of a diesel engine;

FIG. 2 is a diagrammatic longitudinal cross-sectional view of the diesel engine, and FIG. 3 is a somewhat enlarged view of the encircled portion of FIG. 2.

DETAILED DESCRIPTION

Referring to FIG. 1, an engine 10, such as a diesel engine, for example, has first and second spaced-apart portions 12, 14 and an air cleaner 16. The engine 10 also includes a block 18 having a general "V" configuration and a fuel pump 20 positioned within the vee and connected to the block 18. The first and second portions 12, 14 have air inlet ports 22, 24, respectively, and are connected to the block 18 and form a portion of the vee. Fuel lines 26 are connected to the pump 20 and first and second portions 12, 14. Valve covers 28, 30 are connected to the respective first and second portions 12, 14.

Referring to FIGS. 1 and 2, a cover 31 is connected to the engine 10 and forms a chamber 32 defined by the first and second engine portions 12, 14, the block 18 and the cover 30. The cover has a middle portion 34, first and second opposed side portions 36, 38 and first and second opposed end portions 40, 42. The side portions 36, 38 are sealably connected to the respective engine portions 12, 14 and the end portions 40, 42 each extend between the engine portions 12, 14 and are connected thereto and to the engine block 18. The side portions 36, 38 are preferably positioned adjacent the respective valve covers 28, 30 and are suitably fastened by bolts or the like. The end portions 40, 42 are similarly fastened by bolts or the like.

The middle portion 34 has a recessed portion 46 with an opening 48 and a ridge 50. The middle portion 34 supports the air cleaner 16 which is mounted thereon by a nut and bolt assembly 52 or the like. The air cleaner 16 includes a housing 54 which is sealably mounted on the ridge 50 and a filter element 56 which is positioned inside the housing 54 and seated in the recessed portion 46 over the opening 48. An annulus 58 is formed between the housing 54 and filter element 56 through which air flows. Air flows through a passageway 59 defined by the filter element 56, opening 48, and chamber 32, to the first and second engine portions 12, 14. The air flows substantially unobstructed around the fuel lines 26 which offer little, if any, resistance to the flow. The chamber 32 therefore is free of heretofore utilized crossover pipes and inlet manifolds (not shown) which obstruct the air flow. The depth of the recessed portion 46 can be adjusted to accommodate a filter element 56 of greater height than the housing 54 which will require less frequent service and replacement.

The cover 31 is preferably constructed of a layer of acoustic material 60, preferably foam organic polymer or the like, positioned between layers of metal 62, preferably steel or the like. An elastomeric sealing gasket 64, such as rubber or the like, is preferably positioned between the cover 31 and engine 10 and forms a hermetic seal. The valve covers 28, 30 and other covers, such as an oil pan 66 and the air cleaner housing 54, are preferably of layered construction.

In operation, dirty air flows into the annulus 58 and is cleaned on its passage through the filter element. The cleaned air flows through the chamber 32 to the first and second engine portions. The cover 31 supports the air cleaner 16 and confines noise to the chamber 32. The sealing gasket 64 helps reduce vibration and noise.

Other objects, aspects and advantages will become apparent from a study of the specification, drawings and appended claims.

The embodiments of the invention in which an exclusive property or privilege is claimed are defined follows:

1. In an engine having first and second opposed end portions, and first and second spaced-apart side portions having a general "V" profile, the improvement comprising:

a cover having a first side portion sealably connected to the first engine side portion, a second side portion sealably connected to the second engine side portion, a first end portion sealably connected to the first engine end portion, a second end portion sealably connected to the second engine end portion, and a middle portion extending between the side and end portions of the cover;

a chamber defined by said engine and said cover and having an opening on the middle portion of the cover; and an air cleaner mounted on the middle portion of the cover over the chamber opening and forming an air passageway substantially free of obstructions to the first and second engine side portions.

2. An apparatus, as set forth in claim 1, wherein said air cleaner includes a housing and a filter element, and wherein said middle portion includes a recessed portion and a ridge, said filter element being seated in said recessed portion, said housing being sealably mounted on said ridge and forming an annulus between said housing and filter element.

3. An apparatus, as set forth in claim 2, wherein said filter element has a greater height than said housing.

4. An apparatus, as set forth in claim 1, wherein said cover is constructed of acoustic material.

5. An apparatus, as set forth in claim 1, wherein said cover is constructed of alternate layers of acoustic material and metal.

6. An apparatus, as set forth in claim 1, including a sealing material positioned between said engine and cover and forming a hermetic sealing gasket therebetween.

7. An apparatus, as set forth in claim 6, wherein said sealing material is an elastomeric material.

8. An apparatus, as set forth in claim 6, including a fuel pump having a plurality of fuel lines and being connected to said first and second engine side portions and positioned within said chamber.

* * * * *